US008523957B2

(12) United States Patent
Arioglu et al.

(10) Patent No.: US 8,523,957 B2
(45) Date of Patent: Sep. 3, 2013

(54) PROCESS FOR INTRODUCING VAT DYES AND CHEMICALS INTO TEXTILES

(75) Inventors: Erol Arioglu, Bursa (TR); Agamirze Hamitbeyli, Bursa (TR); Kenan Loyan, Bursa (TR); Mustafa Esref Tuncer, Bursa (TR); Hamit Yenici, Mudanya (TR)

(73) Assignee: SANKO Tekstil Isletmeleri San. ve Tic. A.S., Bursa (TR)

( * ) Notice: Subject to any disclaimer, the term of this patent is extended or adjusted under 35 U.S.C. 154(b) by 1057 days.

(21) Appl. No.: 11/199,142

(22) Filed: Aug. 9, 2005

(65) Prior Publication Data

US 2007/0033748 A1 Feb. 15, 2007

(51) Int. Cl.
*D06P 5/00* (2006.01)

(52) U.S. Cl.
USPC ..... 8/502; 8/537; 8/650; 8/651; 8/652; 8/653

(58) Field of Classification Search
USPC ..... 8/401, 502, 650–653, 537
See application file for complete search history.

(56) References Cited

U.S. PATENT DOCUMENTS

| | | | | |
|---|---|---|---|---|
| 1,038,945 | A * | 9/1912 | Thompson | 24/706.3 |
| 3,761,297 | A * | 9/1973 | Figueras et al. | 106/410 |
| 4,950,306 | A | 8/1990 | Marte et al. | |
| 5,518,508 | A * | 5/1996 | Kuehnel et al. | 8/502 |
| 5,586,992 | A | 12/1996 | Scnitzer et al. | |
| 6,129,769 | A * | 10/2000 | Xu et al. | 8/401 |
| 2003/0115688 | A1 * | 6/2003 | Hartgrove et al. | 8/445 |
| 2005/0097685 | A1 | 5/2005 | Seuthe et al. | |

FOREIGN PATENT DOCUMENTS

| | | |
|---|---|---|
| GB | 1509450 | 8/1975 |
| GB | 1596740 | 12/1976 |

OTHER PUBLICATIONS

International Search Report and Written Opinion of related PCT Application (mailed May 18, 2006).

* cited by examiner

*Primary Examiner* — Tri V Nguyen
(74) *Attorney, Agent, or Firm* — IP Authority, LLC; Ramraj Soundararajan

(57) ABSTRACT

A process for using reduced vat dyes in a continuous dyeing process for production of dyed yarns and fabrics of different colors. In the process, dye composition is introduced to a treatment unit for reduction to desired dye composition. The dye concentration in the treatment unit is lower than feeding dye concentration so that dye precipitation does not occur, but significantly higher than the circulating dye concentration so that the dye is reduced efficiently. Although the preferred location for the treatment unit is before the circulation line, it may be at any location before the dip-dye tank.

12 Claims, 7 Drawing Sheets
(2 of 7 Drawing Sheet(s) Filed in Color)

PROCESS FOR INTRODUCING VAT DYES AND CHEMICALS INTO TEXTILES

BACKGROUND OF THE INVENTION

1. Field of Invention

The present invention relates generally to the field of dyeing textiles. More specifically, the present invention is related to using vat dyes in a continuous process to produce a variety of colors during the production of denim.

2. Discussion of Prior Art

"The older, the better look" has been the philosophy of the blue jean industry. Blue jeans are dark blue when they are first produced. As they are worn and washed, the abraded places become a different color than the rest. Today there are numerous techniques to produce this natural washout look in denim. Some of these techniques include stone washing, enzyme washing, bleaching, acid washing, resin treatment, ozone washing, neutralization, tinting and garment dyeing, local tinting, chemical spraying, local bleaching, sand blasting, brushing, laser, moustache or whiskers, damage and cutting. However, this natural worn-out or washout effect only happens with fabric produced with yarn that has ring effect dyeing (i.e., perimeter dyeing), or specifically in blue jean denim, dyed with Indigoid vat dye. Ring effect in yarn is defined when dye does not penetrate into the yarn and only perimeter/external dyeing is achieved.

Today, the production of yarns with ring effect dyeing is feasible only through a few continuous processes. The most popular continuous processes used for dyeing yarns are rope (long chain) dyeing, slasher (sheet) dyeing, and loop dyeing (looptex). In these processes, indigo-derived vat dye is added in reduced form or in mixture with reducing agents to a dye tank. FIGS. 1-4 illustrate prior art for continuous dyeing cotton yarns or fabric.

Indigo is a water insoluble organic substance that can be reduced to a water-soluble form and used to dye yarns or fabrics. Following dyeing, the dye is oxidized, which returns the dye to its water insoluble form on the yarn. Indigoid vat dyes have been primarily used for cotton yarns, which have given rise to the popularity of denim fabric today.

It is known, in the continuous dyeing of yarns, to add the dye in the form of a concentrated stock vat. FIGS. 1 and 2 illustrate 2-16 dip-dye tanks equipped with squeezing/skying apparatus used for applying the vat dyes. A minimum of 2 dip-dye tanks is required for rope and slasher dyeing. Squeezing and skying takes place between the dipping steps and the dye is oxidized by air passage. To avoid dye depletion of the dip vats, the dye is replenished from stock vat dyes having a concentration greater than 80 g/l or concentration of at least 20% stock vat. These reduced stock vat dyes are introduced in the circulation line at the dye tank. FIG. 3 illustrates loop-dyeing process wherein direct beam is introduced to at least one dip-dye tank and squeezing/skying apparatus. The direct beam is recycled or looped several times in the same dip-dye tank. FIG. 4 shows continuous dyeing process for fabric where "ready-to-dye" fabric is added to a series of dip dye tanks squeezing/skying apparatus.

Similar to indigo, other vat dyes (indigoid or anthraquinonoid) also have excellent all-round fastness properties on cotton. However, unlike indigo, most vat dyes have high molecular weight, high substantivity, and low solubility. Hence, for most vat dyes no reduced stock solution is available in the market to use in denim fabric production. Additionally, adding reducing agents to high concentration of most vat dyes in feeder dye tank results in precipitations due to their poor solubility.

It is desired to produce textile material with ring effect dyeing using different colors, such as, but not limited to: orange, red, violet, pink, green, yellow, black, brown, blue, khaki, gray, purple, navy, beige, or other vat dye colors or combinations thereof. However, the production of textile material with ring effect dyeing has been limited to vat dyes with high solubility, limiting the color of denim fabric. Vat dyes, in particular anthraquinonoid vat dyes, have a wide range colors. However most these different color dyes have low solubility.

U.S. Pat. No. 5,518,508 (hereinafter referred to patent '508) discloses a method for continuous dyeing of yarn. Patent '508 uses dye dispersion instead of stock vat to solve the problem of supersaturation and insufficient concentrated stock vat. However, the circulating concentration of dyes is usually low (approximately 50:1 ratio from stock vat to circulating dye) which results in low reduction rate of vat dye. It is known that the vatting rate is a function of dye and reducing agent concentration. The prior art requires a high concentration of reducing agent for reduction of dyes in the circulating liquor. Increased unreduced dye in the circulating dip-dye tank results in poor dyeing and finished yarn has poor rubbing and washing fastness.

Whatever the precise merits, features, and advantages of the above cited references, and none of them achieve or fulfill the purposes of the present invention.

SUMMARY OF THE INVENTION

In the present invention, all vat dyes may be used individually or in combination with other dyes in a continuous process for production of yarn or fabric with ring effect dyeing. Vat dyes are introduced to a treatment unit comprised of at least one reaction unit where the reducing agent is added to a mixture comprising a dye composition, caustic soda and/or other components or additives known in the art of textile dyeing. The dye concentration in the reaction unit is lower than feeding dye concentration so that dye precipitation does not occur, but significantly higher than the circulating dye concentration so that the dye is reduced efficiently. Although the preferred location for the reaction unit is before the circulation line, any location before the dip-dye tank is within the scope of the present invention.

The present invention enables the production of textile material of different colors, such as orange, red, violet, pink, green, yellow, black, brown, blue, khaki, gray, purple, navy, beige, and/or other vat dye colors or combination thereof. In particular, the different color denim of this invention can be embodied in clothing garments such as pants, skirts, shirts, hat, or jacket. Specific examples of colors or garments should not limit the scope of the invention.

The present invention further enables the production textile material of different shades of colors, such as different shades of orange, red, violet, pink, green, yellow, black, brown, blue, khaki, gray, purple, navy, beige, and/or other vat dye colors or combination thereof. In particular, the darker shades of textile material of this invention may be used to produce clothing garments such as pants, skirts, shirts, hat, or jacket.

In one embodiment of the present invention, the treatment unit has at least one reaction unit where unreduced dye composition, caustic soda, and reducing agent are mixed and the reaction started. Each reaction unit has a residence/retention time (hereinafter referred to as RT) that is a function of reaction unit volume, flow rate, and mixing parameters depending on reaction unit design. Each vat dye requires a different RT depending on the vat dye half-life, solubility, and other chemical properties.

In another embodiment of the present invention, the treatment unit has several reaction units in parallel with each unit containing a different dye composition, wherein each dye composition has a different half-life, solubility, and other chemical properties.

In yet another embodiment of the present invention, the treatment unit may further include milling and/or an ultrasound apparatus.

In a further embodiment of the present invention, a continuous dyeing process for textile material to produce ring effect dyeing comprises at least one treatment unit used at a location before the dip-dye tank.

In yet another embodiment of the present invention, the continuous textile material dyeing process used in conjunction with the treatment unit is rope-dyeing, slasher-dyeing, loop-dyeing, or continuous fabric dyeing.

According to the invention, all vat dyes can be used individually or in combination. The desired vat dye or combination of vat dyes can be added at the desired concentration to the treatment unit to achieve a desired reduced dye concentration.

Suitable substrates for dyeing are all cellulose type and/or blend yarns including, but not limited to, cotton, wool, linen, or viscous. These yarns are, in a preferred embodiment, subsequently predominantly made into denim articles.

The present invention embodiments produce denim with ring effect. The denim fabric may be further processed to produce washout or worn-out look jeans with different colors.

The present invention embodiments include the production of clothing garments such as pants, skirts, shirts, hats, or jackets from denim from the present invention dyeing techniques.

BRIEF DESCRIPTION OF THE DRAWINGS

The patent or application file contains at least one drawing executed in color. Copies of this patent or patent application publication with color drawing(s) will be provided by the Office upon request and payment of the necessary fee

DESCRIPTION OF THE PREFERRED EMBODIMENTS

Figure 1:
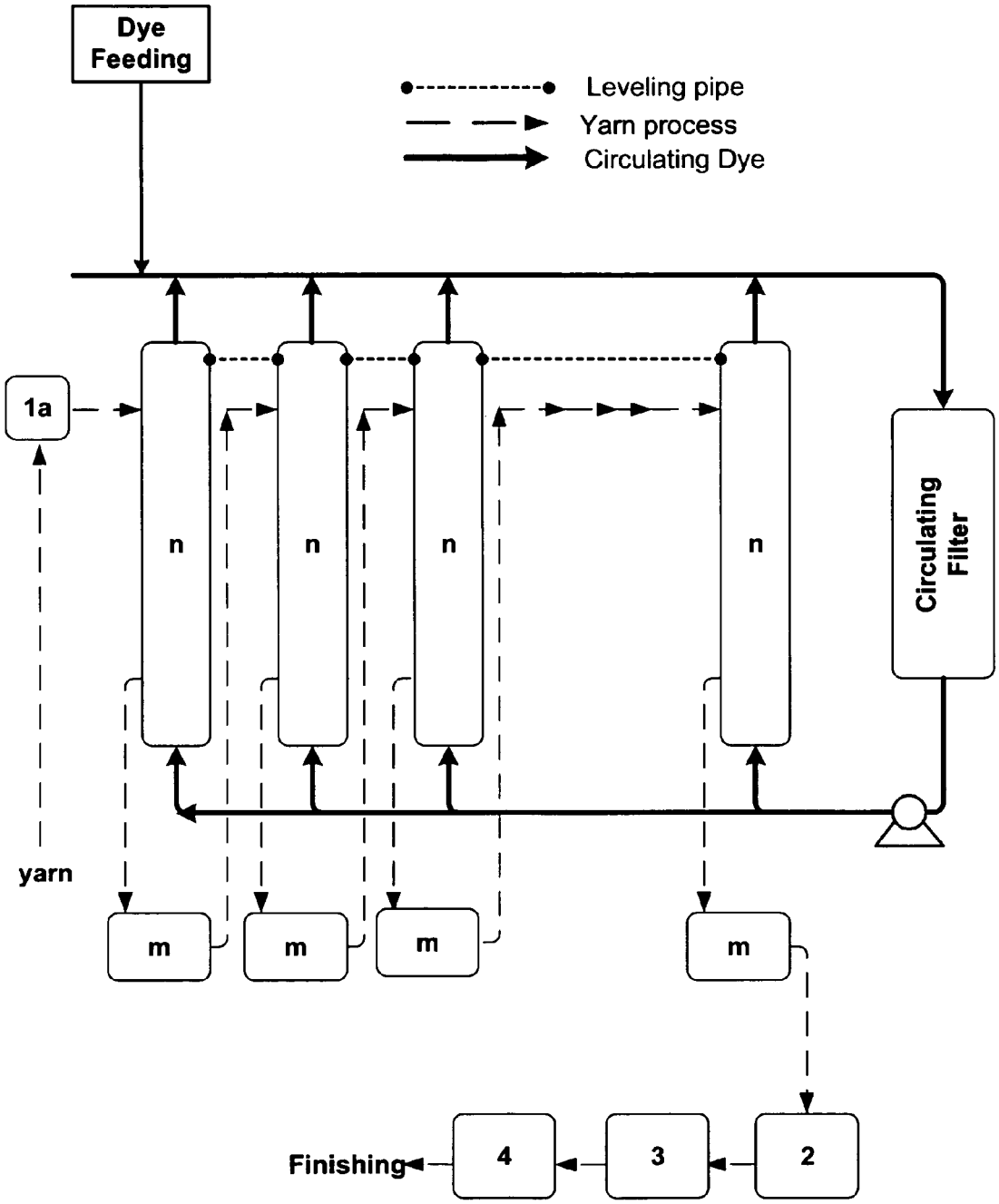
Figure 1 (Prior Art)
FIG. 1 illustrates prior art rope dyeing with reduced stock vat dyes.

While this invention is illustrated and described in a preferred embodiment, the invention may be produced in many different configurations. There is depicted in the drawings, and will herein be described in detail, a preferred embodiment of the invention, with the understanding 5' that the present disclosure is to be considered as an exemplification of the principles of the invention and the associated functional specifications for its construction and is not intended to limit the invention to the embodiment illustrated. Those skilled in the art will envision many other possible variations within the scope of the present invention.

FIG. 1 illustrates a rope-dyeing method common in the prior art. In this method, yarn is first introduced to a warping process 1*a*. Next, warped yarn is introduced to a series of n dip dye tanks (where n is preferably from 2-16) and m squeezing/skying apparatus (where m=n) for applying the vat dyes to warp yarns. The warp yarn is then introduced in sequence to a re-beaming apparatus 2, sizing/slashing apparatus 3, weaving apparatus 4, and finally to a finishing step.

Figure 2:
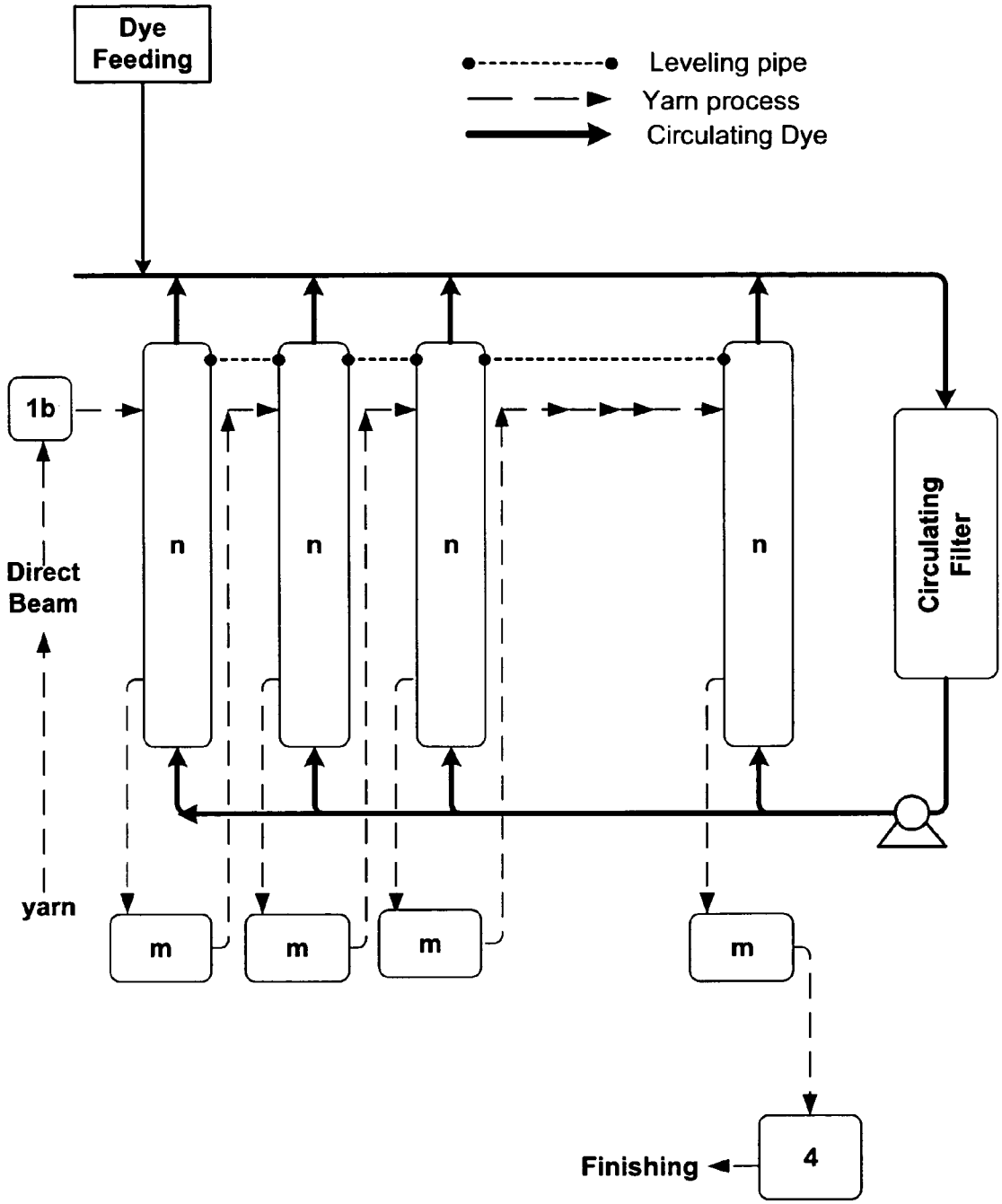
Figure 2 (Prior Art)
FIG. 2 illustrates prior art slasher dyeing with reduced stock vat dyes.

FIG. 2 illustrates a slasher-dyeing method common in the prior art. In this method, yarn is introduced to a beaming process 1*b*. Next, direct beam is introduced to series of n dip dye tanks (where n is preferably from 2-16) and m skying apparatus (where m=n) for applying the vat dyes. The beam is then fed through weaving apparatus 4 and finally to a finishing step.

Figure 3:
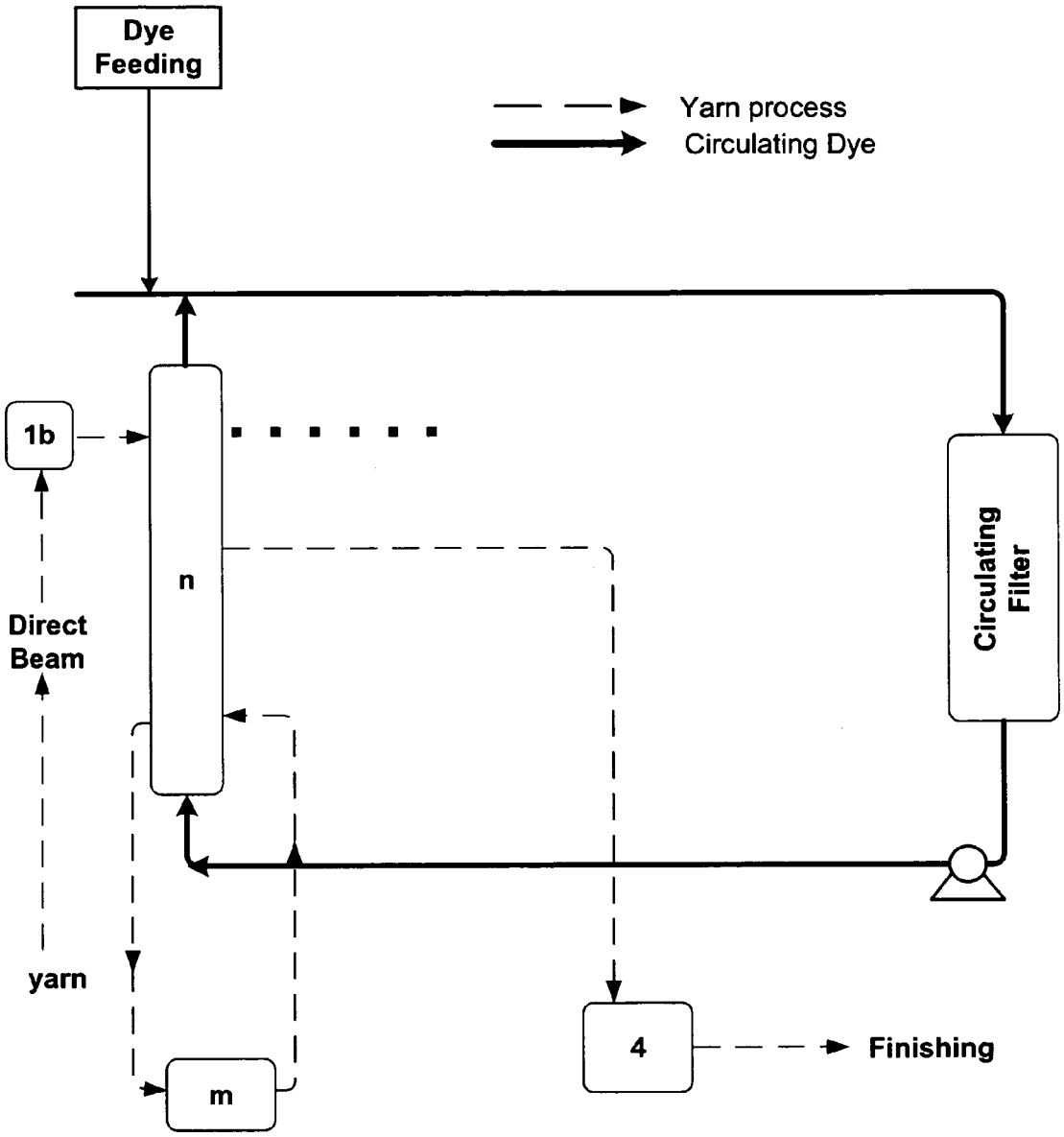
Figure 3 (Prior Art)
FIG. 3 illustrates prior art loop dyeing with reduced stock vat dyes.

FIG. 3 illustrates a loop-dyeing method common in the prior art. In this method, yarn is introduced to a beaming process 1*b*. Next, the direct beam is introduced to series of n dip dye tanks (where n is at least 1) and m squeezing/skying apparatus (where m=n) for applying the vat dyes. In a loop dye process, the direct beam may be recirculated in each dip dye tank several times. The beam is then fed through weaving apparatus 4 and finally to a finishing step.

Figure 4:
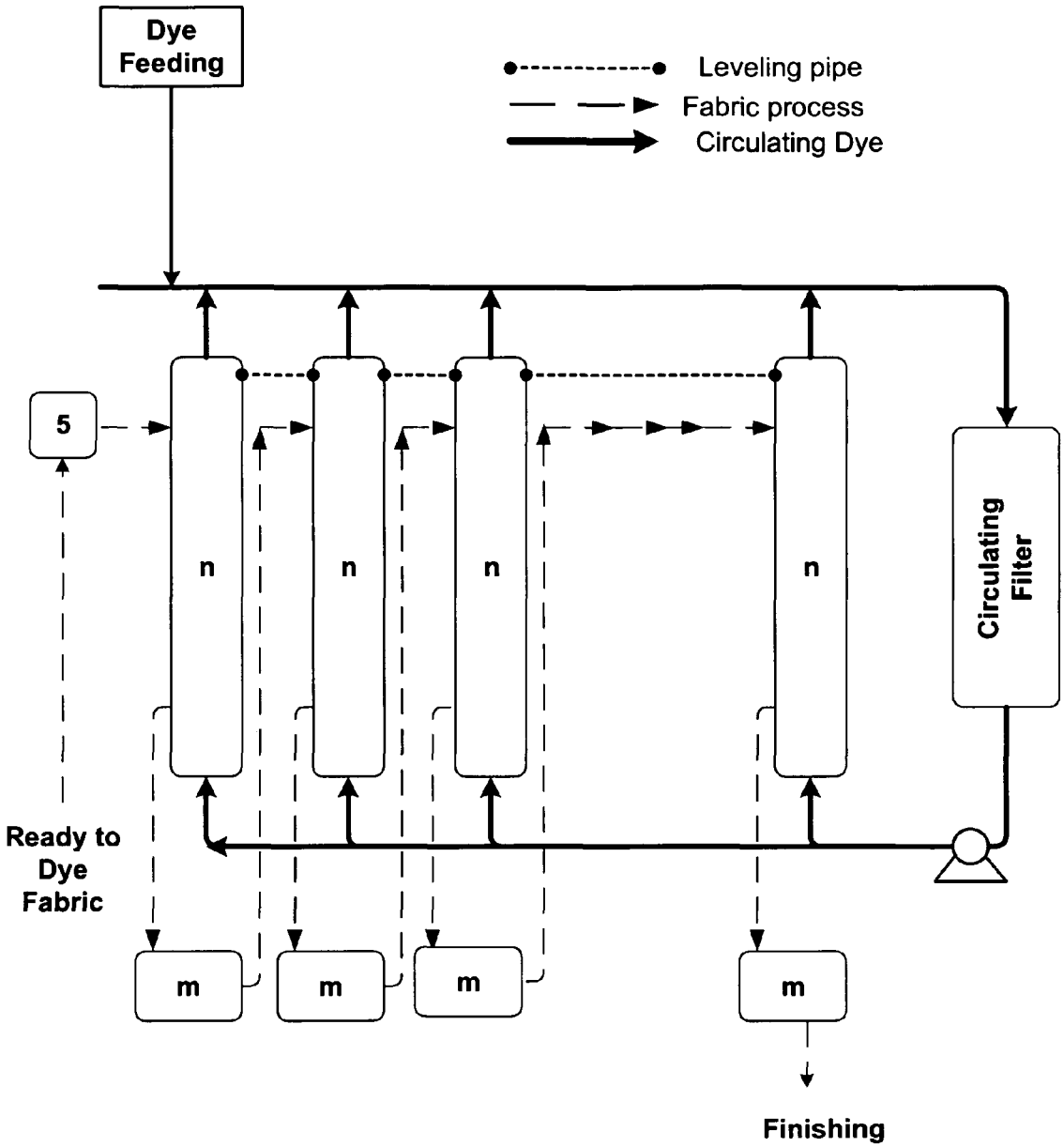
Figure 4 (Prior Art)
FIG. 4 illustrates prior art continuous dyeing for fabric with reduced stock vat dyes.

FIG. 4 illustrates a continuous fabric dyeing method common in the prior art. Ready for dyeing fabric is rolled in 5. Next, the fabric is introduced to series of n dip dye tanks (where n is at least 1) and m squeezing/skying apparatus (where m=n) for applying the vat dyes. In a continuous process, the fabric may be recirculated in each dip dye tank several times.

The n dip-dye tanks illustrated in FIGS. 1-4 are connected in parallel via a circulation line. However other configurations such as a series configuration or a combination of both series and parallel are with the scope of this invention. An example series/parallel combination configuration is when n dip-dye tanks are in a parallel configuration in the circulation line with respect to one another, while each tank is also connected in series via a leveling pipe. The circulation line may further comprise non-limiting additional elements, such as suction unit at end of each dip-dye tank, circulation pipe, circulation pump or other elements known in the art of dyeing textiles.

Figure 5:
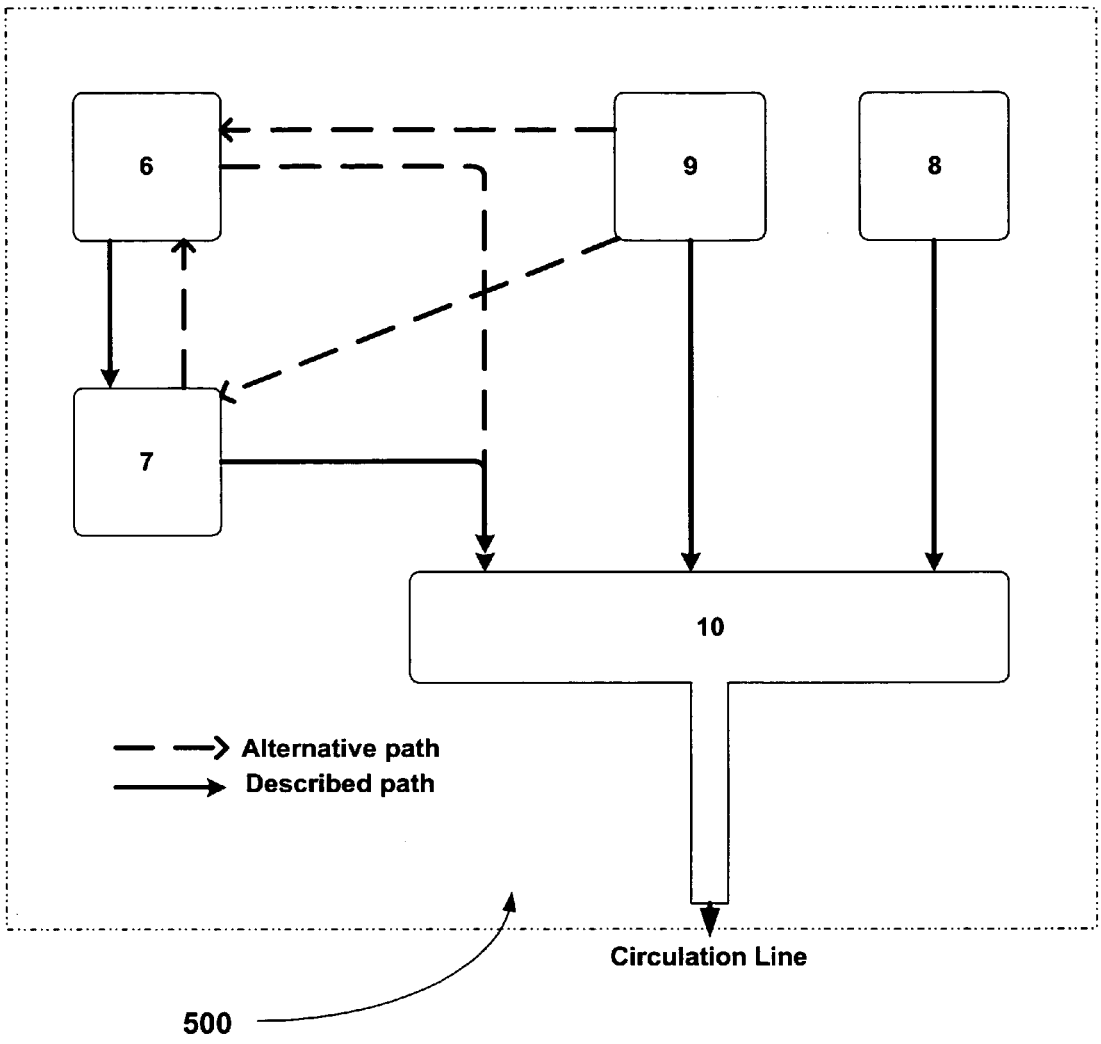
FIG. 5 illustrates treatment unit of the present invention.

FIG. 5 illustrates the treatment element of the present invention. This unit may be at any location before the dip-dye tanks. However the treatment unit 500 is preferably located between the dye tank 6 and the circulation line, in a pre-circulation configuration. The treatment unit has at least one reaction tank 10. The additives 9, including but not limited to, caustic soda, may be added at any location before to the reaction unit. The volume of reactor or pipe and/or a combination thereof where the reducing agent 8 is first introduced to a mixture of dye and additives and the volume of pipe before the mixture enters the circulation line; defines the reaction unit. Additives 9 may also be simultaneously added with the reducing agent 8 to the reaction unit 10. Alternatively, additive 9 can be added to the dye tank 6.

An unreduced dye composition located in tank 6 comprising of at least one vat dye may be first introduced to a milling and/or dispersion apparatus 7 and further introduced to a reaction unit 10 (or in an alternative configuration: 7 may be by-passed or it may proceed or be combined with 6). Several dye mixtures (dye composition, plus additives 9) may enter the reaction unit 10 or alternately each mixture enters a different reaction unit. Where several reaction units exist, the units may be arranged in a parallel and/or series configuration. The reduced dye from each reaction units may be mixed before entering the circulating unit or alternatively each reduced dye may enter independently to the circulation unit.

Reaction unit 10 has an RT that is a function of reaction volume, flow rate, and mixing parameters-depending on reaction unit design. Each vat dye requires a different RT depending on the vat dye half-life, solubility, and other chemical properties. Hence RT for each reaction unit can be determined based on chemical and physical properties of each vat dye.

Where a mixture of vat dyes is used; the properties of the least soluble or mixture may be used for RT design.

The treatment unit may have several parallel reaction units. Each reaction unit may have a different RT and/or temperature. This configuration provides for use of vat dyes of different solubility in a continuous process. Each reaction unit may be specifically designed for a particular vat dye (based on RT, temperature, or other parameters to control reaction rate) to achieve a desired reduced dye composition.

Alternatively, it may be desired to reach a specific mixture of reduced or unreduced dye. The RT and temperature maybe adjusted to achieve any desired ratio of reduced-to-unreduced dye.

Figure 6A:
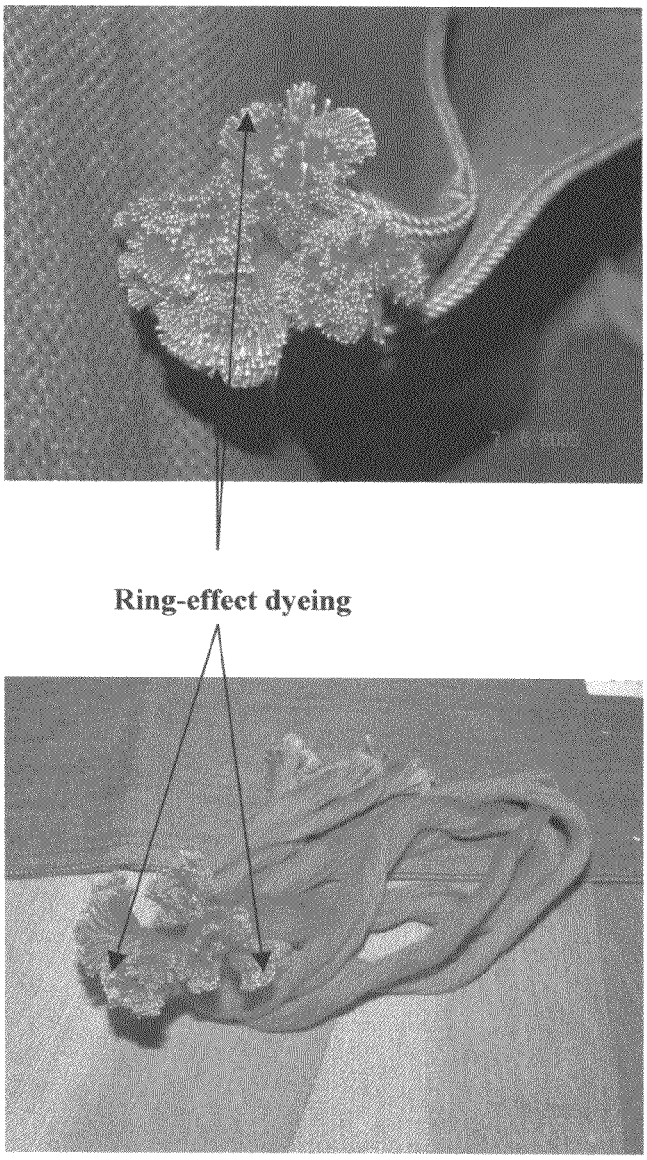
FIGS. 6*a* and 6*b*, collectively, illustrate yarn and denim fabric produced from yarn dyed in a continuous process with Vat Red 10 (C.I. 67000).
Figure 6B:
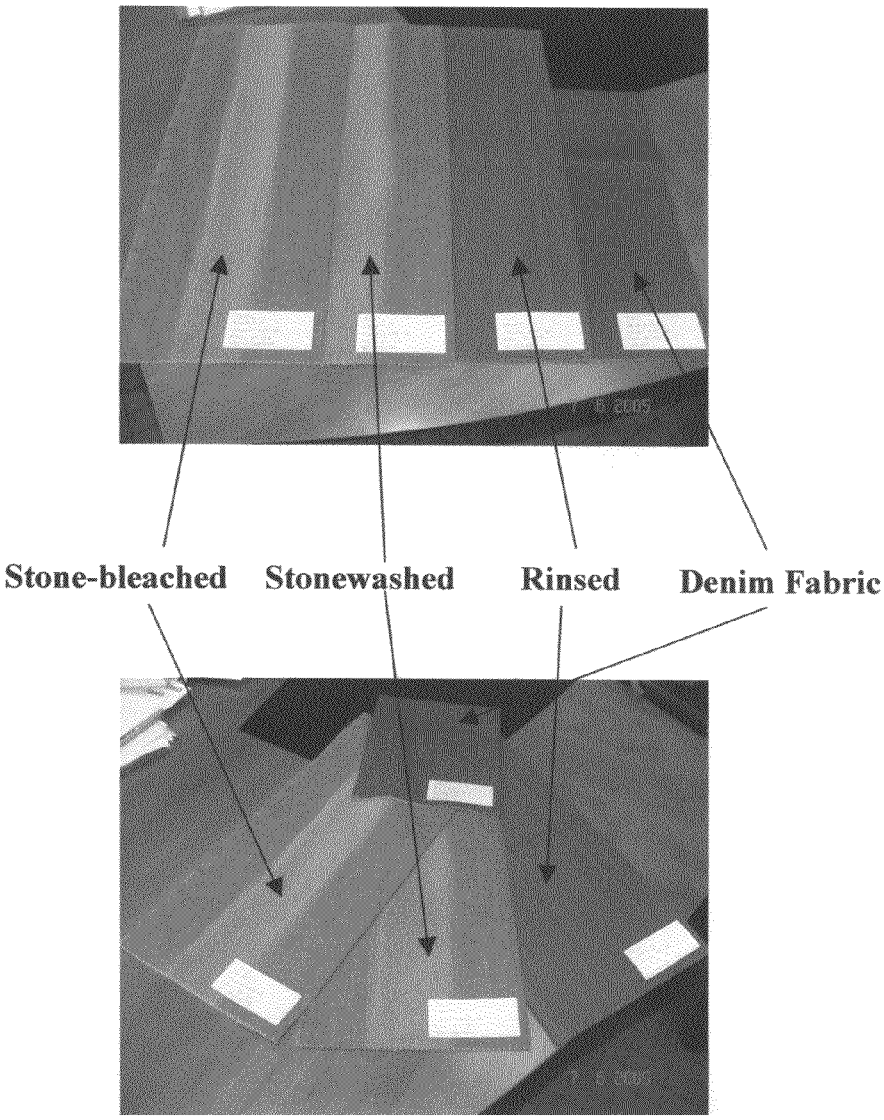

FIG. 6*a* illustrates two configuration of desired ring effect dyeing of yarn dyed with Vat Red 10 (C.I. 67000) in the continuous rope-dyeing process used in conjunction with the treatment unit of the present invention. FIG. 6*b* illustrates various garment samples made from the yarn of FIG. 6*a* further rinse washed, stonewashed, or stone-bleached.

In these processes, the number of dip dye tanks is at least 2, preferably from 8 to 16. Depending on the dye and the reducing agent, dyeing temperatures are 20 to 90° C., preferably from 35-45° C.

Suitable reducing agents are any of, or a combination of the following: sodium dithionite, thiourea dioxide, hydroxyacetone, or mixtures or equivalents thereof.

The anthraquinonoid vat dye is any of, or a combination of, the following or their equivalents: Vat Brown 3 (C.I. 69015), Vat Black 25 (C.I. 69525), Indanthren Direct Black 5589, Vat Violet 1 (C.I. 60010), Vat Red 13 (C.I. 70320), Vat Red 10 (C.I. 67000), Vat Yellow 2 (C.I. 67300), Vat Orange 15 (C.I. 69025), Vat Blue 6 (C.I. 69825), or Vat Brown 1 (C.I. 70800).

EXAMPLE 1

Cotton yarn dyed with darker shades of Vat Red 10 (C.I. 67000):

Anthraquinonoid vat dye was used in pilot plant operation using treatment unit of the present invention in conjunction with rope-dyeing process.

Feeding Preparation:

Dye Composition in Dye Tank

The dye composition in the dye tank was made in the following order. A solution 5 g/l of dispersing agent (Setamol WS, commercially available) was made. Next, complexing agent (Trilon TB) was added to a final concentration of 2 g/l. Next, Vat Red 10 (C.I. 67000) was added to the solution to make a final concentration of 150 g/l of dye. Finally, the wetting agent was added to the solution to a final concentration of 3 g/l. This composition was introduced to the reaction unit at a rate of 0.10 l/min.

Caustic Feeding

Caustic composition of the additive tank was made as follows. Prepared 40 Be caustic solution (494 g/l of sodium hydroxide) with 47 Be caustic (668 g/l sodium hydroxide, commercially available). This composition was introduced to the reaction unit at a rate of 0.40-0.45 l/min.

Reduction Agent Composition

Reducing agent composition of tank was made in the following order. Prepared 25 g/l of caustic from 47 Be (668 g/l sodium hydroxide, commercially available). Add sodium dithionite to a final concentration of 150 g/l. This composition was introduced to the reaction unit at a rate of 0.40-0.45 l/min.

Treatment Unit:

Reaction Unit Composition

Dye composition, caustic composition, and reducing agent with above-mentioned rates were mixed in the reaction unit with a volume of 2.5-3.0 liters. The RT of the treatment unit under this condition was approximately 2.7-3 minutes. The reduced dye was introduced to the circulation unit at a rate of 0.90-1.00 l/min.

Pilot Continuous Rope-Dyeing Process with Treatment Unit:

10 dip-dye tanks, with total volume of 2400 liters were used for rope dyeing. The circulation rate was 100-120 l/min. Dip-dye tank temperatures were 40-45° C. The process had output of 1128 gram-yarn/min. The process had a pH of 12.5-12.7.

The produced red warp yarn was further processed by standard rebeaming apparatus, sizing/slashing apparatus, weaving apparatus, and finally finished to produce red denim. The fabric was made into a garment wherein the garment is further processed by rinse washing, local scraping, stonewashing, and stonewashing plus bleaching. FIGS. 6*a* and 6*b* illustrate dyed yarn and garment produced using these conditions.

EXAMPLE 2

Higher Indanthren Direct Black 5589 concentrations in the treatment unit yields higher dyeing performance.

Equipment

Spectral reflectance measurements for estimation of color strength were done with Datacolor Spectroflash SF600. Concentrations measurements were made with Metrohm Titroprocessor 726, Dosimat 685 and Stirrer 728 by red-ox titration method. Relative dye concentration (herein after C*) is defined as dye concentration (hereinafter C) divided by factor k, where k is defined as the ratio of formula weight of Indathren Direct Black 5589 (hereinafter FWb) divided by formula weight of Indigo (hereinafter FWi).

$$C^*=C/k$$

(where k=FWb/Fwi)

Solution Preparation

C=3 g/l 0.75 g Indanthren Direct Black 5589

2.75 ml Caustic soda (48%)

1.13 g Hydrosulphite 250 ml volume solution is prepared by adding these chemicals to distilled water. 10 ml of this solution was fed used for solubility measurement.

C=30 g/l 7.5 g Indanthren Direct Black 5589

27.5 ml Caustic soda (48%)

11.3 g Hydrosulphite 250 ml volume solution is prepared by adding these chemicals to distilled water. 1 ml of this solution was diluted with 9 ml weak hydrosulphite-caustic soda solution and used for solubility measurement.

C=60 g/l 15 g Indanthren Direct Black 5589

55 ml Caustic soda (48%)

22.6 g Hydrosulphite 250 ml volume solution is prepared by adding these chemicals to distilled water. 5 ml of this solution was diluted to 100 ml using weak hydrosulphite-caustic soda solution and 10 ml of the diluted solution was used for solubility measurement.

Weak Hydrosulphite-Caustic Soda Solution (4, 7×10-3 M)

0.5 ml Caustic soda (48%)

0.82 g Hydrosulphite

Distilled water

Solubility Measurement

Tables 1-3 show that increase in dye input to the treatment unit increases the amount of solved dye. For comparison purposes, measurements of the samples from the treatment unit were done with the appropriate dilution with weak hydrosulphite-caustic soda solution.

TABLE 1

| C = 3 g/l | | |
|---|---|---|
| | t (minutes) | |
| | 3 | 15 |
| C* | 0.578 | 0.583 |

(C* was directly measured)

TABLE 2

| C = 30 g/l | | |
|---|---|---|
| | t (minutes) | |
| | 3 | 17 |
| C* | 0.597<br>0.605 | 0.657<br>0.638 |

(C* was measured with 1:10 dilution)

TABLE 3

| C = 60 g/l | | |
|---|---|---|
| | t (minutes) | |
| | 3 | 16 |
| C* | 0.631 | 0.643 |

(C* was measured with 1:20 dilution)

Dyeing Performance

Conditions in Tables 1-3 were used for the treatment unit to investigate dyeing performance. The feed rate for the treatment unit for the three conditions depicted in Tables 1-3 was adjusted so that the dip-dye tank concentration (hereinafter Cb) remained at 3 g/l. The color strength of the dyed fabric was measured using a Datacolor Spectroflash SF600. Table 4 shows the result of these measurements.

TABLE 4

| Dyeing results | | |
|---|---|---|
| C (g/l) | Cb (g/l) | Color Strength (CMC 2:1) |
| 3 | 3 | 100 |
| 30 | 3 | 123.76 |
| 60 | 3 | 143.20 |

The examples provided in this application are for the exemplification of the principles of the invention and the associated functional specifications for its construction and is not intended to limit the scope of the invention.

CONCLUSION

The present invention provides for a method and apparatus to use all vat dyes, regardless of the solubility, in a continuous process for textile material. The invention is useful for production of denim with ring effect dyeing. In particular the invention provides for a method and apparatus to produce different colored denim, such as orange, red, violet, pink, green, yellow, black, brown, blue, khaki, gray, purple, navy, beige, and/or other vat dye colors or combination thereof.

The invention claimed is:

1. A method of generating reduced anthraquinonoid vat dye composition used in a continuous process of dyeing textile material, said method as implemented in a treatment unit comprising:

(a) applying a high concentration anthraquinonoid vat dye composition stored in a plurality of dye tanks into a reaction unit connected to a circulation line of said continuous dyeing process, said dye tanks having a combined volume ≧2000 liters, said reaction unit having a residence/reaction time (RT) that depends on at least anthraquinonoid vat dye half-life and solubility, said anthraquinonoid vat dye concentration in said treatment unit being greater than 80 g/L, said RT and temperature adjusted to achieve a desired ration of reduced-to-unreduced dye;

(b) applying at least one reducing agent from a reducing agent tank to said reaction unit having said anthraquinonoid vat dye;

(c) effecting isolated reduction of said anthraquinonoid vat dye composition in said treatment unit outside of said circulation line prior to introducing said anthraquinonoid vat dye composition in to said circulation line, said reducing done using said introduced reducing agent to form a reduced anthraquinonoid vat dye;

(d) introducing said reduced anthraquinonoid vat dye into said circulation line of said continuous dyeing process only after said step of reducing anthraquinonoid vat dye in said treatment unit wherein dyeing temperature is between 35-45° C. and, following dyeing;

(e) oxidizing said reduced anthraquinonoid vat dye by air passage; and, wherein anthraquinonoid vat dye concentration in said treatment unit is lower than feeding dye concentration resulting in no dye precipitation and dye concentration in said treatment unit is higher than circulating dye concentration resulting in effective dye reduction.

2. The method of claim 1, wherein said reducing agent is any of, or a combination of, the following: sodium dithionite, thiourea dioxide, or hydroxyacetone.

3. The method of claim 1, wherein said continuous process is any of the following: rope dyeing process, a slasher dyeing process, a loop dyeing, or a continuous fabric dyeing process.

4. The method of claim 1, wherein said textile material is any of, or a combination of, the following: cellulosic type material, cotton, wool, linen, and viscose.

5. The method of claim 1, wherein said textile material is used in the production of denim.

6. The method of claim 5, wherein said denim material is further processed to produce a washed or worn look.

7. The method of claim 6, wherein said washed or worn look is achieved via any of, or a combination of, the following finishing processes: stone washing, enzyme washing, bleaching, acid washing, resin treatment, ozone washing, neutralization, tinting, local tinting, chemical spraying, local bleaching, sand blasting, brushing, laser, moustache or whiskers, damage and cutting.

8. The method of claim 1, wherein said textile material is yarn or fabric.

9. The method of claim 1, wherein said textile material produced in a variety of colors, said color comprising orange, red, violet, pink, green, yellow, black, brown, blue, khaki, gray, purple, navy, beige, and/or other vat dye colors or combination thereof.

10. The method of claim 9, wherein said colored textile material produced has a dark shade, due to higher concentrations of reduced dye in dyeing tanks enabled by the treatment unit.

11. The method of claim 1, wherein in addition to said anthraquinonoid vat dye, any one of, or a combination of, the following vat dye are additionally applied in said at least one dye tank: Vat Brown 3 (C.I. 69015), Vat Black 25 (C.I. 69525), Indanthren Direct Black 5589, Vat Violet 1 (C.I. 60010), Vat Red 13 (C.I. 70320), Vat Red 10 (C.I. 67000), Vat Yellow 2 (C.I. 67300), Vat Orange 15 (C.I. 69025), Vat Blue 6 (C.I. 69825), or Vat Brown 1 (C.I. 70800).

12. The method of claim 7, wherein said finishing processes are fine tunable, due to well-defined correlation between concentration and color strength, originating from a wide range of pre-reduction concentrations enabled by said treatment unit.

* * * * *